US006308449B1

(12) United States Patent
Plebani

(10) Patent No.: US 6,308,449 B1
(45) Date of Patent: Oct. 30, 2001

(54) PERMANENT SAFETY DEVICE FOR PREVENTING THE ACCIDENTAL FIRING OF A FIREARM

(75) Inventor: Dario Plebani, Ome (IT)

(73) Assignee: Franchi S.p.A., Brescia (IT)

( * ) Notice: Subject to any disclaimer, the term of this patent is extended or adjusted under 35 U.S.C. 154(b) by 0 days.

(21) Appl. No.: 09/247,130

(22) Filed: Feb. 9, 1999

(51) Int. Cl.[7] ..... F41C 17/82

(52) U.S. Cl. ..... 42/70.08; 42/66; 42/70.01; 89/148

(58) Field of Search ..... 42/66, 70.08, 70.01, 42/70.04, 70.05, 70.09; 89/147, 154, 148

(56) References Cited

U.S. PATENT DOCUMENTS

| | | | | |
|---|---|---|---|---|
| 4,282,795 | * | 8/1981 | Beretta | 89/148 |
| 4,680,884 | | 7/1987 | Smith | 42/66 |
| 5,068,990 | * | 12/1991 | Marzocco | 42/70.04 |
| 5,216,195 | * | 6/1993 | Tuma | 89/147 |
| 5,417,001 | * | 5/1995 | Rousseau | 42/70.08 |
| 5,548,914 | | 8/1996 | Anderson | 42/66 |
| 6,119,387 | * | 9/2000 | Butters et al. | 42/70.08 |

FOREIGN PATENT DOCUMENTS

| | | |
|---|---|---|
| 903440A | 7/1998 | (BE) . |
| 0540778 | 5/1993 | (EP) . |
| 505526 | 10/1919 | (FR) . |

* cited by examiner

*Primary Examiner*—Michael J. Carone
*Assistant Examiner*—Kyongtaek K. Mun
(74) *Attorney, Agent, or Firm*—Sofer & Haroun, LLP

(57) ABSTRACT

Permanent safety device for preventing the accidental firing of a weapon whose firing mechanism comprises a trigger, a hammer, a loaded spring which exerts a force along a given line of action on said hammer, retention means which hold the hammer in opposition to said spring and, inserted between the trigger and said hammer retention means, a lever which disengages these latter at the time of firing as a result of the trigger being pulled. The abovementioned firing mechanism includes a stop piece which can be moved between an interference position in which it interferes with the action of said spring on the hammer and a position in which it does not interfere with said action, and vice versa, and a mechanism, connected to the trigger, which is designed to move said stop piece out of said interference position only if the trigger is pulled.

10 Claims, 7 Drawing Sheets

PERMANENT SAFETY DEVICE FOR PREVENTING THE ACCIDENTAL FIRING OF A FIREARM

FIELD OF THE INVENTION

The present invention relates to a permanent safety device for preventing the accidental firing of a weapon whose firing mechanism comprises a trigger, a hammer, a loaded spring which exerts a force along a given line of action on said hammer, retention means which hold the hammer in opposition to said spring and, inserted between the trigger and said hammer retention means, a lever which disengages these latter at the time of firing as a result of the trigger being pulled.

BACKGROUND OF THE INVENTION

Firing mechanisms of the type detailed above are well known within the firearms sector, in both hunting and military guns.

The fact these mechanisms include a safety device which can be engaged and disengaged manually is also well known.

The known manual safety devices usually used in firearms consist of catch mechanisms which, once engaged, make it impossible to move those components which are designed to disengage the hammer retention means and therefore, even if pressure is exerted on the trigger, prevent the sequence of movements that result in a shot being fired from taking place, including, in particular, the movement of the hammer which, as is known, is permanently subjected to the action of a spring.

Despite immobilizing the components mentioned above, or even the trigger, by means of the conventional safety devices found in firearms, there is still the problem—and one which can sometimes have extremely serious consequences—of the gun firing accidentally as a result of the hammer retention means being disengaged inadvertently.

As mentioned earlier, the hammer is permanently subjected to the action of a spring and is held in opposition to the latter by means which are usually in the form of a hook.

If these means should, for whatever reason—for example as a result of a violent knock to the weapon or wear of the hooking surfaces—cease to function properly, the hammer is released and the force of the spring is fully discharged onto said hammer, causing the gun to fire accidentally.

The object of the present invention is to equip the firing mechanism of a firearm of the type specified above with a permanent safety device which is independent of the conventional safety catch and which, even if the hammer retention means are released or disengaged accidentally, will not allow the hammer, even though it is subjected to the force of the spring, to receive a sufficient force to cause the gun to fire.

SUMMARY OF THE INVENTION

This object is achieved by a permanent safety device for preventing the accidental firing of a weapon whose firing mechanism comprises a trigger, a hammer, a loaded spring which exerts a force along a given line of action on said hammer, retention means which hold the hammer in opposition to said spring and, inserted between the trigger and said hammer retention means, a lever which disengages these latter at the time of firing as a result of the trigger being pulled. The permanent safety device includes a stop piece which can be moved between an interference position in which it interferes with the action of said spring and a position in which it does not interfere with said action, and vice versa, and a mechanism, connected to the trigger, which is designed to move said stop piece out of said interference position only if the trigger is pulled.

BRIEF DESCRIPTION OF THE DRAWINGS

The invention will now be described in greater detail with reference to a number of practical embodiments thereof which are given solely by way of non-limiting example and illustrated in the appended drawings, in which.

DETAILED DESCRIPTION OF THE PREFERRED EMBODIMENTS

Figure 1:
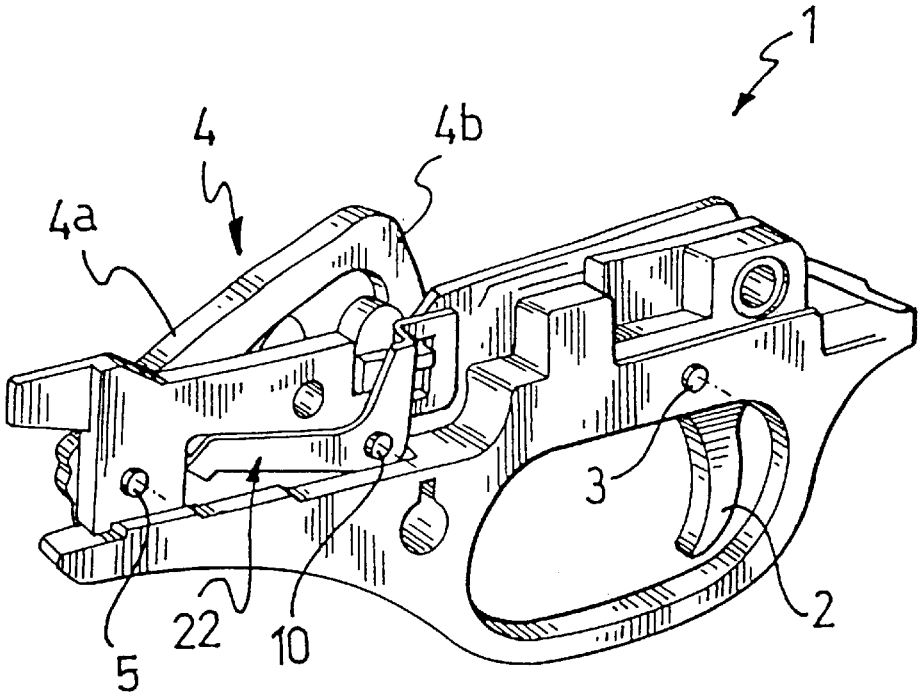
FIG. 1 shows a perspective view of the basic elements of a firing mechanism of a firearm, especially a hunting rifle or shotgun, fitted with the permanent safety device according to the invention in a first embodiment.
Figure 2:
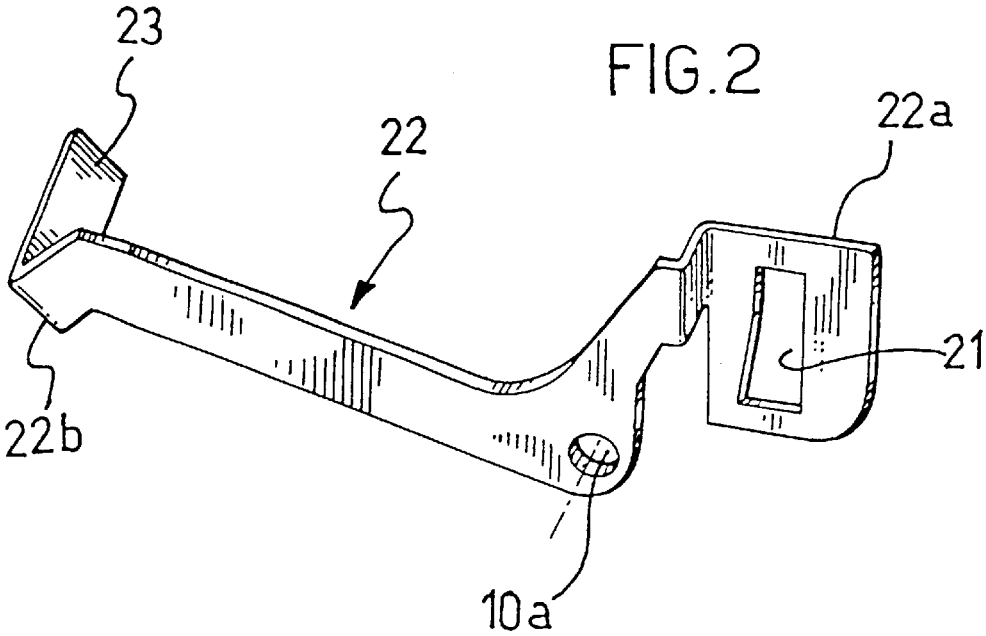
FIG. 2 shows a perspective view of a component of the mechanism of the permanent safety device according to the invention, from the embodiment shown in FIG. 1.

With reference to the abovementioned figures and in particular to FIGS. 1 to 4, the reference 1 denotes, overall, the support frame of the firing mechanism of a firearm, for example a shotgun.

The trigger 2 pivots on the pin 3 and the hammer 4 is mounted so that it can rotate about the pin 5.

In the example described, the hammer 4 takes the form of a cranked lever having a longitudinal portion 4*a* and a transverse portion 4*b*.

The latter portion terminates in a hook-shaped end 6, the front of which engages with another hook 7 carried on the end 8 of a lever 9 which is mounted so that it can rotate about the pin 10.

The other end 11 of the lever 9 is designed to work in conjunction with a catch element of the conventional safety system which has not been illustrated since it is not relevant to the present invention.

The back 12 of the hammer is, in the conventional manner, designed to strike the firing pin (not illustrated in the drawings) at the time of firing as a result of its rotation about the pin 5.

The side 13, opposite the back 12 of the hammer, carries a projection 14 which is permanently in contact with the end 15 of a cap 15*a* which at least partially encloses a compressed spring, shown diagrammatically as 16. The other end 17 of the spring 16 reacts, in the conventional manner, against the frame 1 which has not been illustrated in FIGS. 3 and 4 for the sake of simplicity and clarity.

The lever 9, its tooth 7 and the tooth 6 of the hammer 4 that engages with the tooth 7, constitute the retention means which hold the hammer in opposition to the thrust force exerted along the line of action X—X by the spring 16 which is in permanent contact with the projection 14 via the cap 15*a*.

Inserted between the lever 9 and the trigger 2 is a lever 18 which, via its end 18*a*, is hinged to the end 2*a* of the trigger by means of a pin 19.

The tip of the other end 18*b* presses against the lever 9, at a point between the pivot pin 10 and the end 8.

This same end 18*b* of the lever 18 has a projection 20, positioned at an angle with respect to the axial extension of the lever, which engages slidably within the window 21 formed in the end 22*a* of a lever 22.

This lever 22 pivots like a rocker arm by means of the hole 10*a* around the pin 10—on which the lever 9 is also pivotably mounted—and carries a transverse piece, denoted 23, on its other end 22*b*.

The projection 20 and the window 21 form a connection means between the lever 18 and the lever 22.

Figure 3:
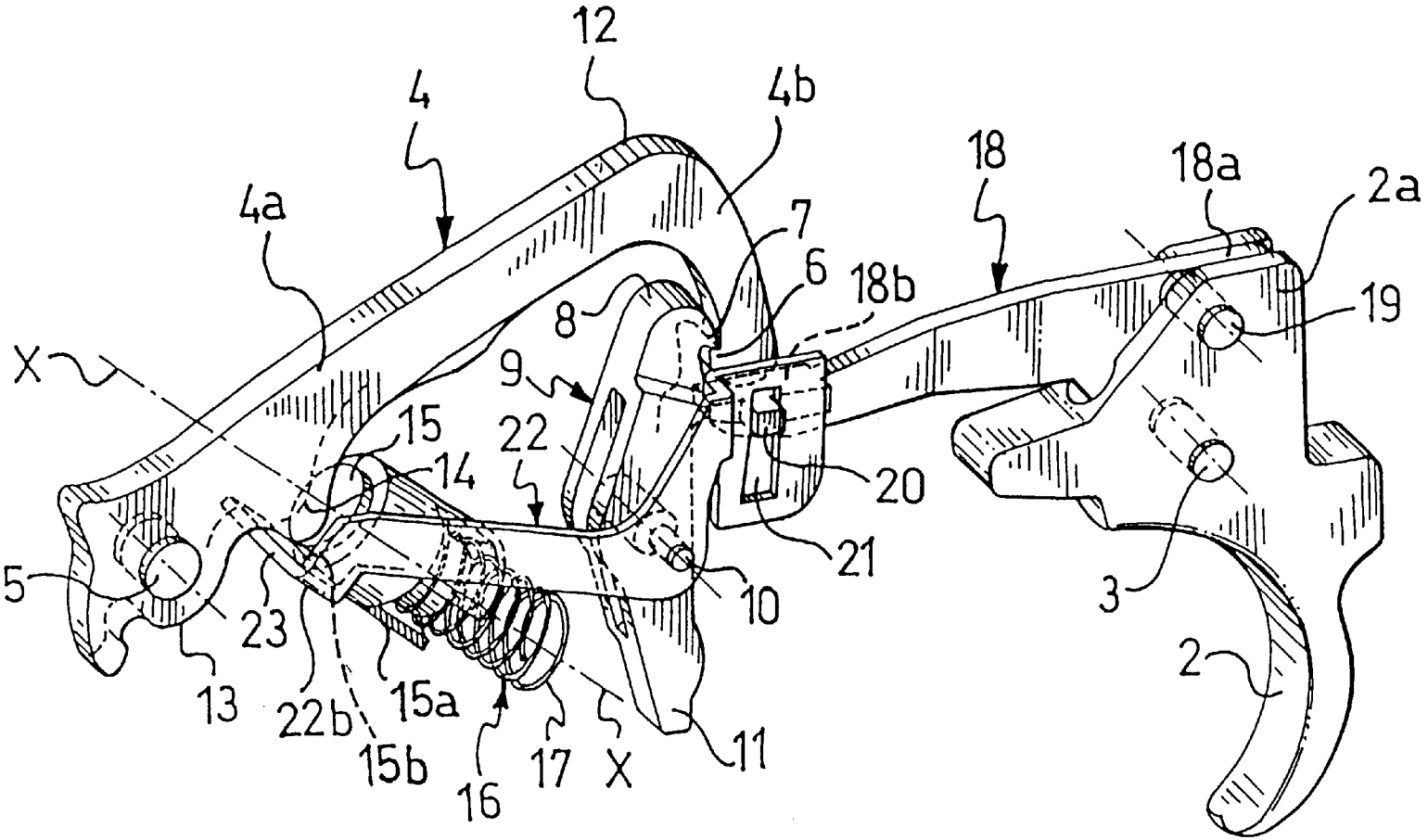
FIG. 3 shows a diagrammatic perspective view of the permanent safety mechanism of the example shown in FIGS. 1 and 2, in the active position.

The piece 23 on the lever 22 is usually positioned such that it interferes with a zone 15*b* affected by the movement of the cap 15*a* containing the spring 16, generally to the side of the line of action X—X of the force of the spring 16, as illustrated in FIG. 3.

In addition, the piece 23 is positioned, in the direction of the line X—X, a preset distance away from the end 15 of the cap 15*a*.

This positioning means that, in the event of the teeth 6 and 7 disengaging for whatever reason—for example as a result of wear of the contact surfaces of the hooked connection or an accidental knock, but not because the trigger 2 has been pulled—the thrust force of the spring 16, whose cap 15*a* is permanently pressed against the projection 14 on the hammer, cannot be fully discharged because, beyond the preset distance, at least part of the end 15 of the cap 15*a* hits the piece 23 on the lever 22, which acts as a stop.

The spring 16 can therefore only transmit a limited thrust via the cap 15*a* to the hammer 4 and this thrust is not enough to release the hammer so that it can strike the firing pin (not illustrated) with sufficient energy to fire a shot.

Only when the shot is intentional, i.e. caused by the trigger 2 being pulled, is the piece 23 on the lever 22 first moved out of the zone of displacement of the spring 16.

The axial movement of the lever 18 and the resultant pressure exerted by the end of the latter on the lever 9, then cause the teeth 6 and 7 to disengage.

When this happens, the hammer can then receive the full force of the spring 16 and so strike the firing pin with sufficient energy to fire the gun.

Displacement of the transverse piece 23, which acts as a stop for the cap 15*a* containing the spring 16 and limits the force of the energy discharged by the latter on the hammer, is achieved by virtue of the connection between the lever 18 and the rocker lever 22.

This is because the axial movement of the lever 18, which gradually causes the tooth 7 to disengage from the tooth 6 on the hammer 4, also causes the angular movement of the lever 22 and, because of the different lengths of the arms relative to the pivot pin 10, moves the piece 23 out of the zone 15*b* of displacement of the cap 15*a*, slightly before disengagement of the teeth 6 and 7 takes place.

The device of the invention therefore constitutes a permanent safety mechanism which does not need to be engaged and disengaged manually.

It is only when the gun is to be fired intentionally that, in an action consequent upon the moving of the trigger, this safety mechanism renders the spring 16 fully active and allows all its energy to be discharged onto the hammer 4 in order to fire a shot.

In all other cases, unless the trigger 2 is moved, the safety device continues to remain active, even when the teeth 6 and 7 accidentally disengage, thereby releasing the hammer.

Figure 4:
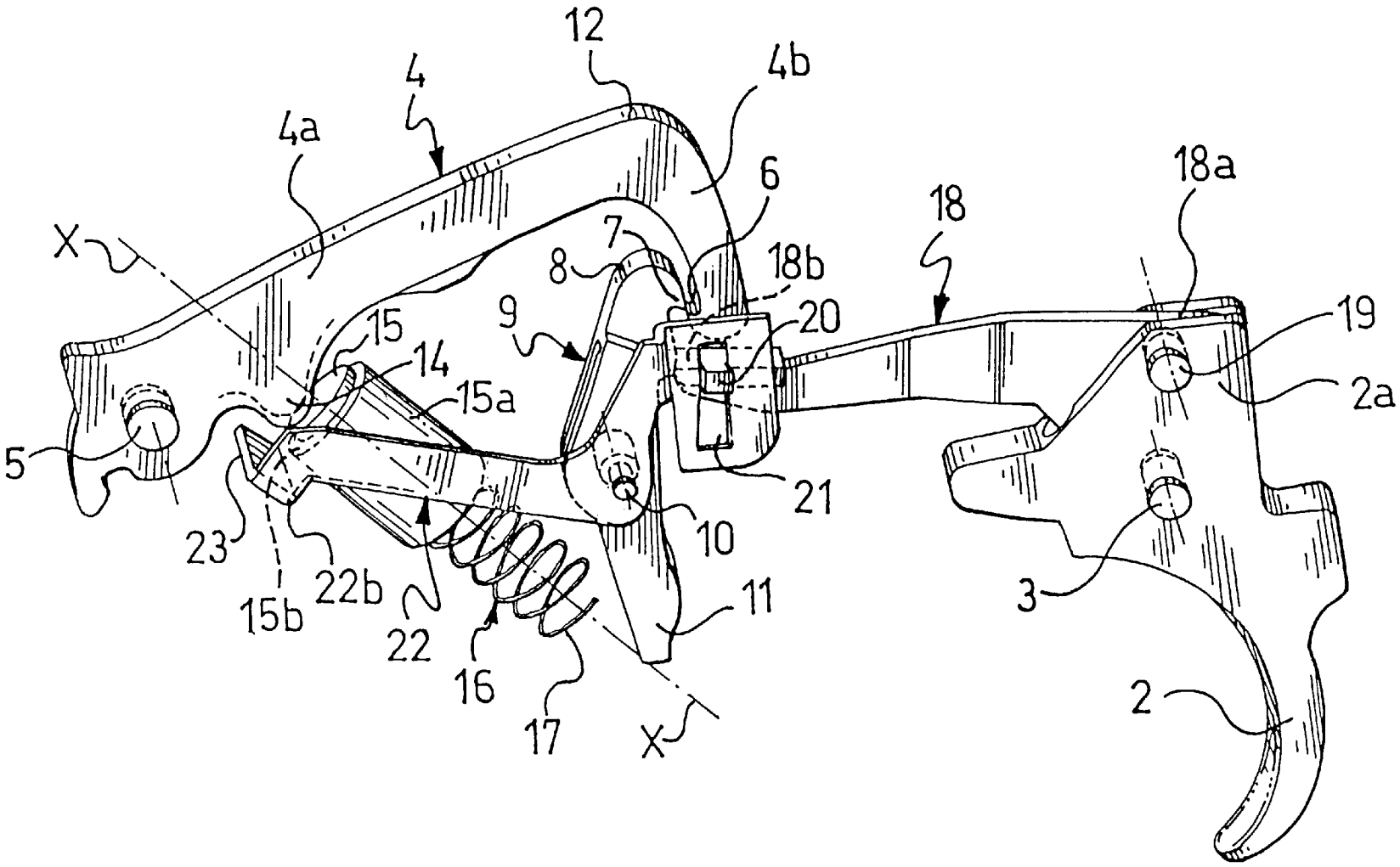
FIG. 4 shows the mechanism of the previous figure in the inactive position that immediately precedes an intentional shot.

More specifically, with reference to the embodiment of FIGS. 3 and 4, if the teeth 6 and 7 do disengage accidentally, the pressure exerted by the spring 16, via the cap 15*a*, on the stop piece 23 tends to cause the lever 22 to rotate clockwise about the pin 10, thereby holding the piece 23 even more firmly in its operational stop position, therefore making the safety device even more effective.

Figure 5:
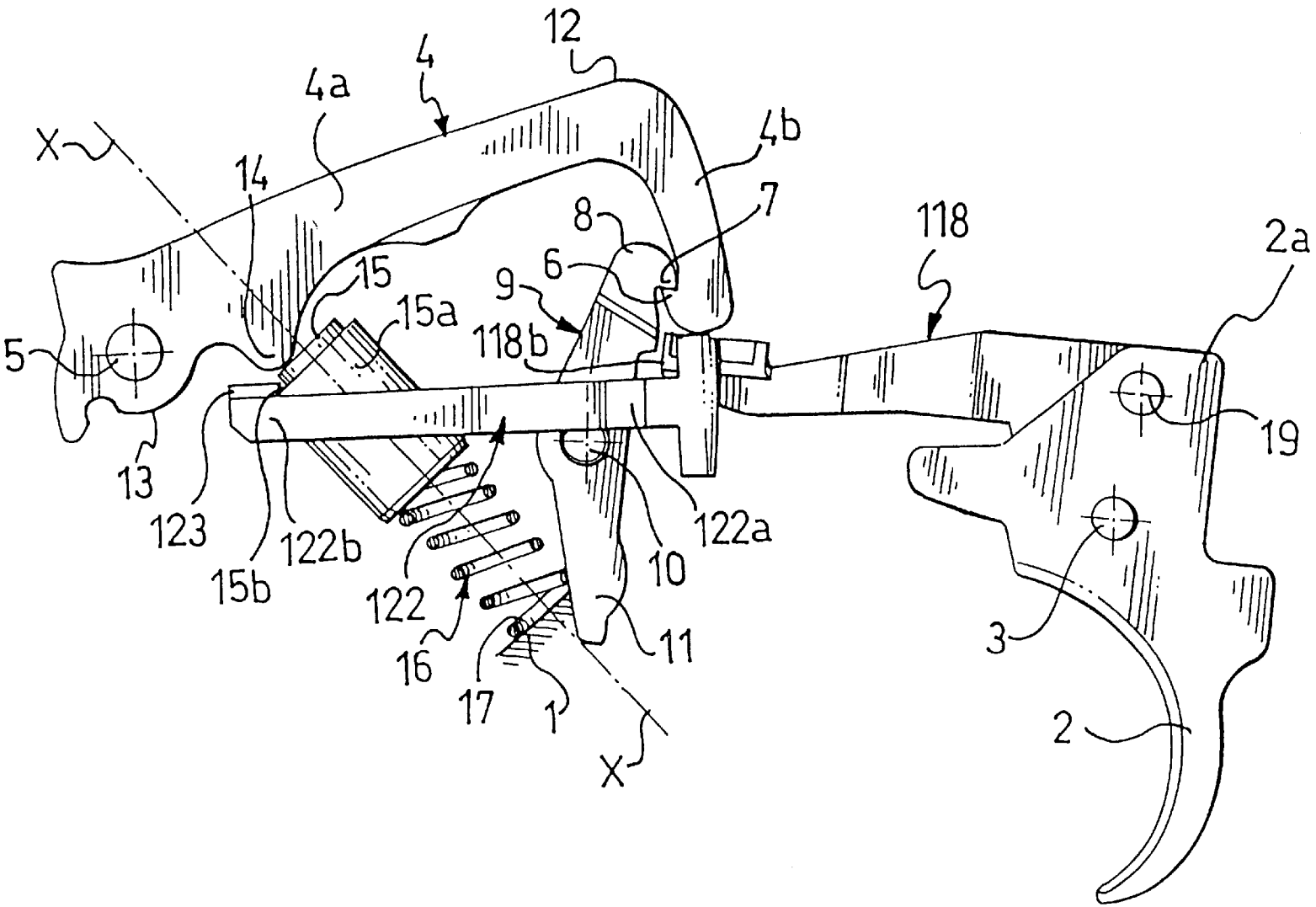
FIG. 5 shows a second embodiment of the permanent safety device according to the invention, in its active position.
Figure 6:
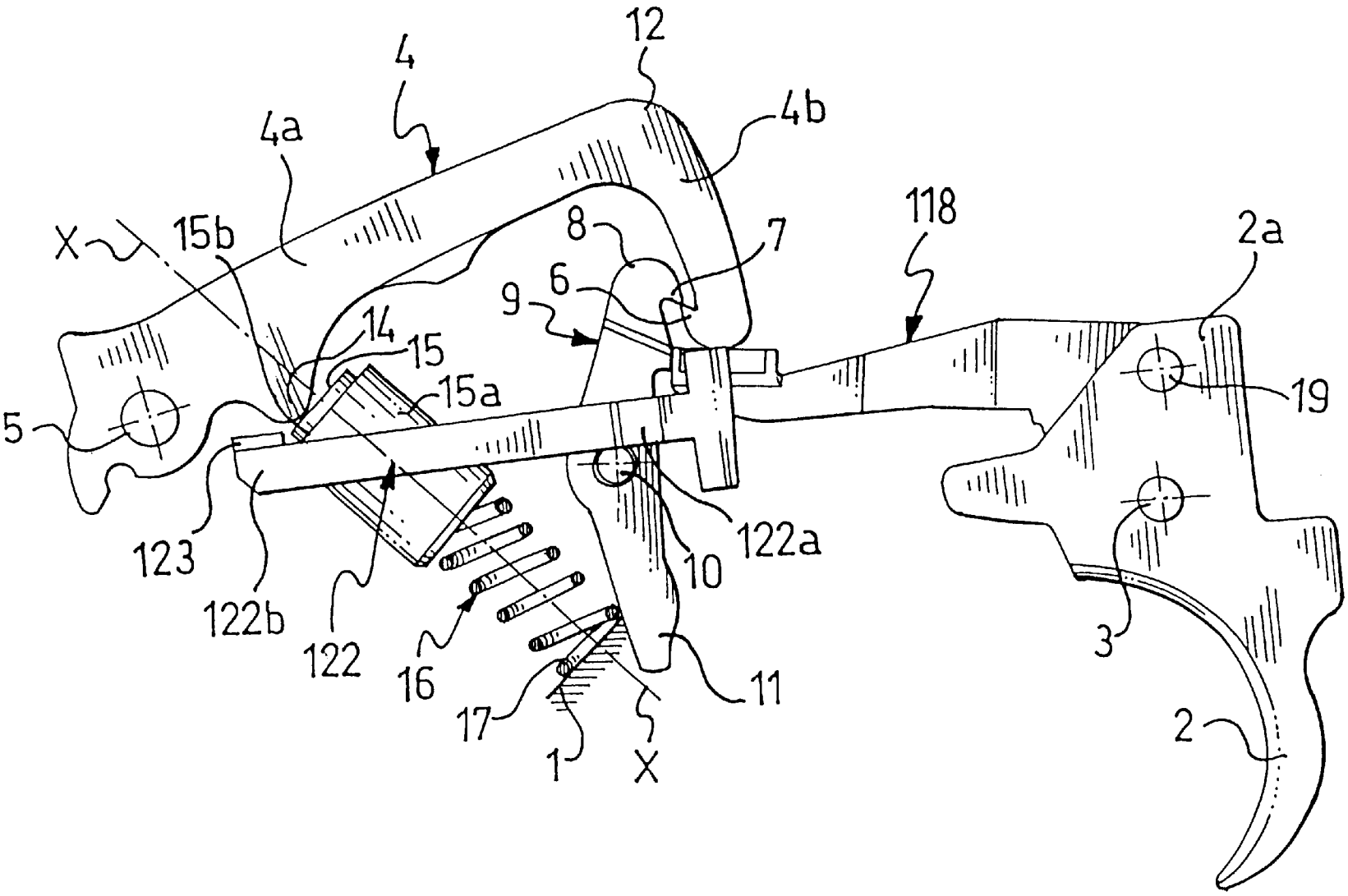
FIG. 6 shows the device of the embodiment shown in FIG. 5 in the inactive position that immediately precedes an intentional shot.

With reference to the example illustrated in FIGS. 5 and 6, in which elements corresponding to those in the embodiment o f FIGS. 1 to 4 have been given the same reference numerals, it will be noted that a stop piece 123 is carried by the end 122*b* of a rod 122 which is mounted on the frame of the weapon such that it can be moved axially in both directions.

The end 122*a* of this rod 122 hooks onto the end 118*b* of the lever 118 which, similarly to the example shown in FIGS. 1 to 4, is actuated by the trigger 2.

Unless the trigger 2 is moved, the stop piece 123 interferes with the action of the spring 16 and so prevents, should the teeth 6 and 7 disengage accidentally, the full elastic force of the spring from being discharged onto the hammer 4 and causing the gun to fire accidentally.

In contrast, when the trigger 2 is pulled, the lever 118 axially pushes the rod 122 while its tip acts simultaneously on the lever 9.

Before the teeth 6 and 7 are disengaged, the rod 112 moves the stop piece 123 out of the way, thereby releasing the spring 16.

Figure 7:
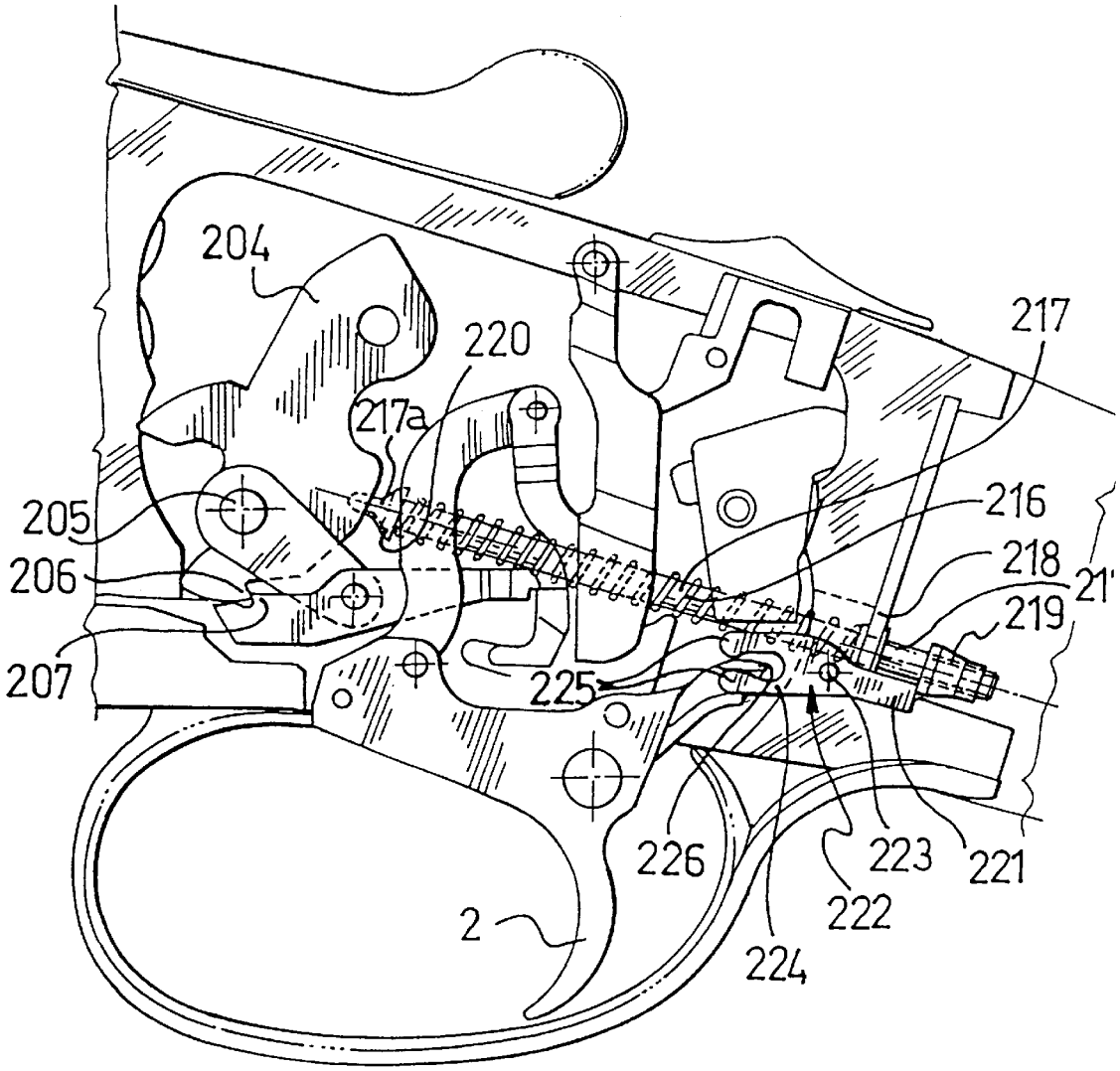
FIG. 7 shows a third embodiment of the permanent safety device according to the invention, in the active position.
Figure 8:
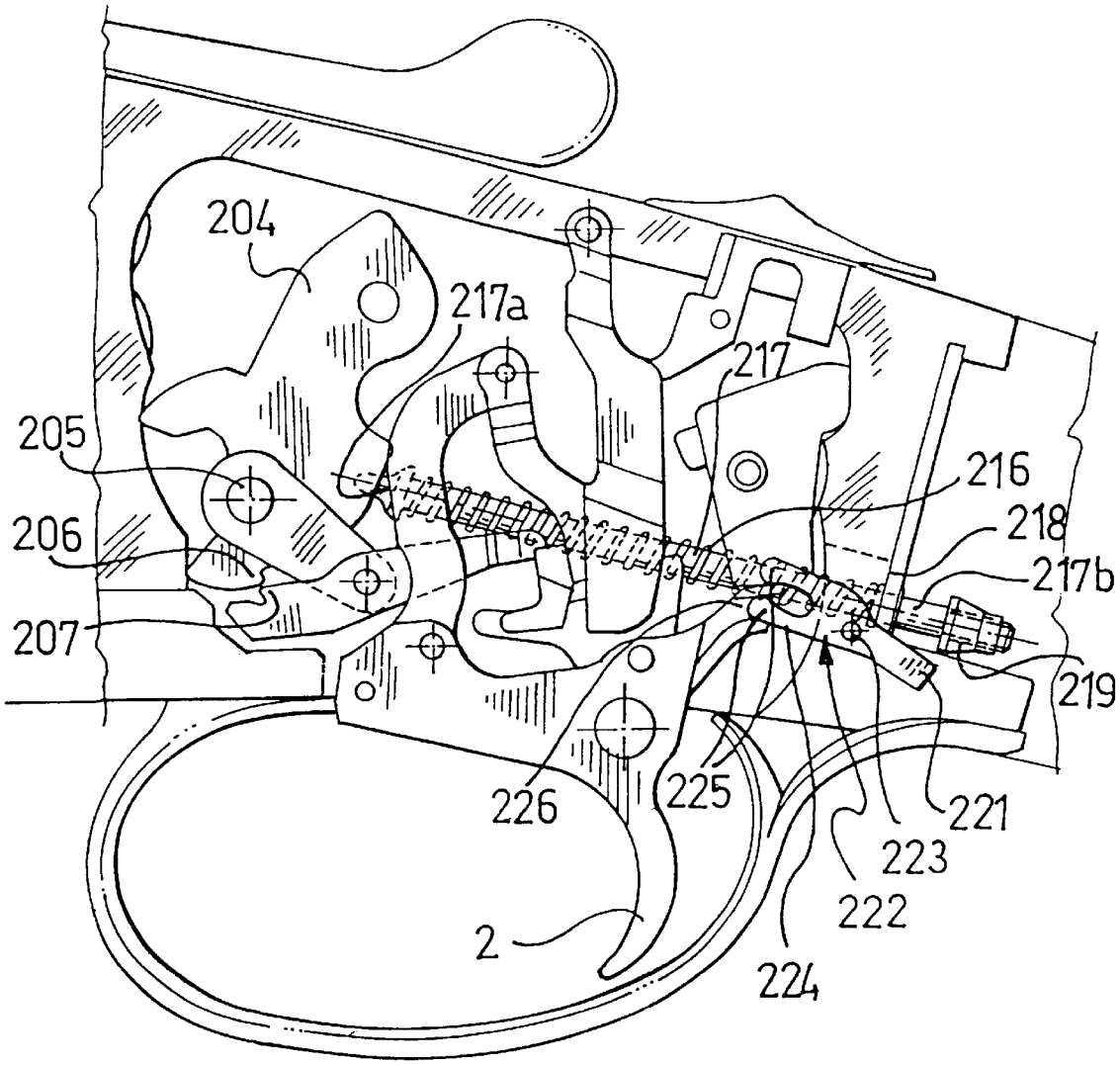
FIG. 8 shows the device of the embodiment shown in FIG. 7 in the inactive position immediately prior to an intentional shot.

With reference to the example illustrated in FIGS. 7 and 8, it will be noted that the permanent safety device according to the invention can also be used in a shotgun in which the barrels are on top of each other and which has a known, conventional firing mechanism.

It should be noted in this example that the spring 216 is mounted coaxial on a rod 217 whose end 217*a* bears against the hammer 204 which can rotate about the pin 205, while a portion 217*b* of its opposite end passes through a wall 218 of the frame and terminates in an enlargement 219 formed, for example, by a nut screwed onto the threaded end of the rod.

When the hammer is in the cocked position, as shown in FIG. 7, in which the teeth 206 and 207 are mutually engaged, the spring 216 is compressed between the wall 218 and the flange 220 of the end 217*a*.

The end 221 of a rocker lever 222, which is mounted so that it can rotate around the pin 223, is inserted along the portion 217*b* and presses against the enlargement 219.

The other end 224 of this lever 222 is forked, its times 225 enclosing the portion 226 of an extension piece integral with the trigger 2.

When the components are in the position described, it is clear that, if the elements retaining the hammer 204 in position—i.e. the teeth 206 and 207—are released, the force of the spring 216 cannot be discharged onto the hammer 204 because the rod 217 is axially immobilized by the end 221 of the lever 222.

With reference to FIG. 8 which relates to the same embodiment, it will be noted that, when the gun is fired intentionally, the action of moving the trigger 2 causes the end 221 of the lever 222 to be moved out of the way even before the teeth 206 and 207 are disengaged, releasing the rod 217 which, as soon as the teeth 206 and 207 are disengaged, discharges the full force of the spring 216 onto the hammer 204, thereby firing the gun.

It will be obvious that the invention described with reference to the specific embodiments detailed above can undergo various modifications, especially with regard to the shape of the mechanical parts and their physical layout within the framework of a firing mechanism, depending on the type of weapon, without thereby departing from the scope of the following claims.

What I claim is:

1. A permanent safety device for preventing the accidental firing of a weapon whose firing mechanism comprises:

a trigger;

a trigger lever connected to said trigger;

a hammer coupled to said trigger lever at a first end of said hammer;

a loaded spring which exerts a force along a given line of action on a second end of said hammer;

a hammer retention means which holds said hammer in opposition to said loaded spring, said hammer retention means being disengaged by said trigger lever when said trigger is activated; and a rocker lever, coupled to said trigger lever and said hammer retention means, said rocker lever further comprising a stop piece movable between a first interference position in which said stop piece interferes with said loaded spring thereby preventing said loaded spring from being fully activated against said second end of said hammer and a second position in which said stop piece does not interfere with said loaded spring when said trigger is activated.

2. The permanent safety device as claimed in claim 1, wherein said stop piece is positioned between said loaded spring and the second end of said hammer.

3. The permanent safety device as claimed in claim 1, wherein said stop piece is positioned directly between said second end of said hammer and said line of action of said loaded spring, so that said stop piece interferes directly with the action of said loaded spring when said stop piece is in said first interference position.

4. The permanent safety device as claimed in claim 1, wherein said rocker lever is provided with first and second ends, said stop piece being integral with said first end of said rocker lever, said second end of said rocker coupled to said hammer retention means so that when said hammer retention means is disengaged by said trigger, said stop piece is moved into said second position.

5. The permanent safety device as claimed in claim 4, wherein said first end of said rocker lever is an axially sliding rod, said axially sliding rod being actuated by said trigger lever in order to disengage said hammer retention means when said trigger is activated.

6. The permanent safety device as claimed in claim 1, wherein said loaded spring further comprises a cap mounted on said loaded spring, said cap having a zone of displacement, wherein said stop piece interferes with said cap in said zone of displacement when said rocker lever is in said first interference position.

7. The permanent safety device as claimed in claim 6, wherein said cap is disposed on said loaded spring and configured, at least in part, to enclose said loaded spring acting on said second end of said hammer.

8. The permanent safety device as claimed in claim 6, wherein said stop piece can be moved between a first interference position in which it interferes with said zone covered by the displacement of said cap and a second position in which it does not interfere with said zone.

9. The permanent safety device as claimed in claim 6, wherein said stop piece is positioned in the direction of said line of action of said loaded spring, a preset distance away from the end said cap of said loaded spring which acts on said second end of said hammer.

10. The permanent safety device as claimed in claim 6, wherein said rocker lever is pivotable about an axis, said rocker lever having first and second arms, said arms being of unequal lengths, so that when said rocker lever is moved by said trigger, said stop piece is moved out of said zone of displacement before said hammer retention means are disengaged.

* * * * *